United States Patent [19]

Wolinski et al.

[11] 4,006,273

[45] Feb. 1, 1977

[54] WASHABLE AND DRY-CLEANABLE RAISED PRINTING ON FABRICS

[75] Inventors: Leon E. Wolinski, Cheektowaga; Arthur R. Endress, Hamburg; David W. Teloh, Depew, all of N.Y.

[73] Assignee: Pratt & Lambert, Inc., Buffalo, N.Y.

[22] Filed: Feb. 3, 1975

[21] Appl. No.: 546,669

[52] U.S. Cl. ..... 427/278; 260/2.5 B; 427/288; 427/373; 427/381

[51] Int. Cl.² ..... B05D 5/00; B05D 3/02

[58] Field of Search ..... 427/264, 270, 271, 373, 427/381, 197, 198, 278, 288; 260/2.5 B

[56] References Cited

UNITED STATES PATENTS

| | | | |
|---|---|---|---|
| 2,827,727 | 3/1958 | Lipsius | 427/198 X |
| 2,861,009 | 11/1958 | Rubner | 427/373 X |
| 2,885,303 | 5/1959 | Kaplan | 260/2.5 B |
| 3,353,981 | 11/1967 | Jacob | 260/2.5 X |
| 3,515,569 | 6/1970 | Walters et al. | 260/2.5 X |
| 3,615,972 | 10/1971 | Morehouse et al. | 260/2.5 X |

*Primary Examiner*—Michael R. Lusignan
*Attorney, Agent, or Firm*—Christel & Bean

[57] ABSTRACT

Raised prints and graphic designs on fabrics which can safely and effectively be drycleaned and washed are provided by formulating a cross-linkable polymer printing medium with about 1 to 45 weight percent thermally expandable microspheres, applying said medium to a fabric, heating at a temperature of about 180° to 250° F to expand the microspheres and cross-link the polymer, and then curing for about 1 minute at a temperature of about 300° F.

10 Claims, No Drawings

WASHABLE AND DRY-CLEANABLE RAISED PRINTING ON FABRICS

The present invention relates to three-dimensional graphic arts, printing, decorating and the like on fabrics. More particularly, it relates to a method of forming three-dimensional graphic designs and the like on a fabric substrate and the three-dimensional representations and forms produced thereby. Still more particularly, the present invention relates to a method for the formation of washable as well as drycleanable and washable three-dimensional designs, printing and the like, on a fabric substrate and the like, and dry-cleanable fabrics bearing the three-dimensional designs formed by such method. The invention described herein represents improvements in the graphic arts techniques, as described in applicants' assignee's copending application Ser. No. 378,704 filed July 12, 1973, now abandoned and preceding applications Ser. No. 259,656 filed June 5, 1972 and Ser. No. 122,086 filed Mar. 8, 1971, both now abandoned, the teachings of which are incorporated by reference herein.

A wide variety of compositions are employed in the fabric arts in order to obtain diverse optical effects. Yet there is always wide-spread demand for new compositions and new techniques which can increase the store of effects available to those of skill in such arts. While many of the compositions and techniques have been known for centuries and yet still find wide-spread usage, the field of fabric decoration is quite a dynamic art, whatever particular branch thereof is considered. The field of art can be generalized to include all those arts which involve the formation of a graphic representation or decorative pattern or the like upon a fabric substrate. Particular examples include such diverse (but interrelated) subdivisions as lithography, silk-screening, photolithography, wood-cuts, stencilling, printing, gravure, roller coater and various combinations of such arts with one another.

It is an object of the present invention to provide compositions for use in the formation of washable and dry cleanable raised or three-dimensional graphic representations on fabrics, a method of forming such representations and the representations so formed.

Another object of the present invention is to provide such compositions in such form that the washable and dry cleanable raised or three-dimensional character is attained after the graphic representation is applied to a fabric substrate, enabling the practitioner of the art to utilize conventional and well-known fabric printing techniques to apply the graphic medium to the fabric substrate and thereafter attain the raised or three-dimensional character.

Still another object is to provide the compositions of the present invention in such form that its utilization can be integrated with conventional procedures, techniques, processing equipment and apparatus without modification thereof and subsequently further treating the compositions to achieve the raised or three-dimensional effect.

It has been found that washable and dry cleanable raised or three-dimensional graphic effects can be attained on fabrics by incorporating into cross-linkable polymer based fabric printing media a minor amount of thermally expandable microspheres, selectively applying such media to a washable and dry cleanable fabric substrate by the applicable techniques therefor, and thereafter heating the selectively coated substrate to expand the microspheres and cross-link the polymer binder. The expansion thus attained creates a raised or three-dimensional result which can be characterized as a continuous matrix of the cross-linked polymer medium employed, containing a disperse phase of expanded microspheres. The applied medium is rendered washable and dry cleanable by a post-curing of the expanded medium at a temperature of about 300° F. for a period of about one minute, up to about three minutes.

The fabric printing media to which the present invention is applicable can be generally defined as any of the diverse media which can be characterized by the formation of a substantially continuous film where selectively applied to a fabric substrate, and in which the microspheres can be incorporated as a disperse phase. In the more common cases, such media usually include a pigment, or the equivalent, and a binder which is capable of forming a substantially continuous solid film upon the chosen fabric substrate and often include a wide variety of other materials, such as one or more of the following: solvents, diluents, opacifiers, fillers, extenders, leveling agents, flow promoters, plasticizers, driers, cross-linking agents, thermal and/or ultraviolet light stabilizers, thixotropic agents, viscosity control agents, wetting agents, dispersing aids, gloss control agents, and the like.

As employed herein, the term "pigment" is intended to be inclusive of that class of materials which may be employed to impart color properties to a graphic medium or media. As such, it is intended to include not only literal pigments but also dyes, lakes, and like materials and precursors thereof as well.

The solid film-forming binder will most often be a natural or synthetic cross-linkable polymer material dissolved in a solvent therefor which, upon evaporation of the solvent or reaction thereof, results in the formation of a substantially continuous, adherent cross-linked film. In other cases, the polymeric material may be a disperse phase of an emulsion or latex or the like. In still other cases, the vehicle may be a liquid or semi-solid polymer precursor, i.e. monomer or "prepolymer" which reacts in situ to provide the film forming polymer. In such cases, the polymerization catalysts may also be included. A solvent or thinner may or may not be required or desired in such systems. Mixtures of polymers may be used as well as single materials.

The preferred binder component is a cross-linkable acrylic addition polymer, desirably in the form of an aqueous emulsion. A particularly preferred binder is an aqueous emulsion of a copolymer of at least about 90 weight percent ethyl acrylate and the balance in addition copolymerizable carboxylic acid group containing monomer, such as acrylic acid, maleic acid, fumaric acid, and the like, formulated with an acid reactive difunctional cross-linking agent. Preferred cross-linking agents for purposes of the present invention are those which react difunctionally with carboxylic acid groups pendant from the polymer chain to form amide cross-linkage species, i.e., diamines, such as ethylene diamine, propylene diamine, polyethylylene diamines, and the like.

A number of such polymer binders are commercially available and are generally familiar to those of ordinary skill in the art. These self-cross-linking acrylic emulsions are preferred because not only do they offer excellent durability and good hand, but also because they tolerate the addition of appreciable amounts of flame retardant salts, which is obviously of great importance to fabric finishing.

Such media are well known to those of ordinary skill in the art and are not per se a part of the present invention. It is accordingly not intended that the invention be construed as limited narrowly to specific media or to particular categories thereof. Nor should the invention be limited with regard to component ingredients of such media except as herein defined.

In accordance with the present invention, expandable microspheres are dispersed into the medium. The microspheres employed in the present invention are hollow thermoplastic particles and are of relatively small size, usually less than from about 200 to 300 microns in diameter and can be as small as about 0.5 microns in diameter. Preferably micron diameters of from about 3 to 50, and more preferably about 5 to 20, are employed. The microspheres have a generally spherical shape and define a generally concentric spherical cavity inside containing about 5 to 50 weight percent of a volatile blowing agent, insoluble or at most only slightly soluble in the thermoplastic material of the microsphere. Microspheres of such character can be prepared with bulk densities ranging from about 50 to 90 pounds per cubic foot. The thermoplastic of the microspheres can be generally any thermoplastic polymer but if the formation of a solution medium is contemplated, the thermoplastic of the microspheres should be preferably different from the foamable coating polymer and preferably not soluble in the solvent.

The microspheres can be conveniently prepared by the techniques referred to as a "limited coalescence" polymerization technique. A typical preparation of such particles is as follows:

A polymerization reactor equipped with an agitator is charged with 100 parts by weight of deionized water and 15 parts by water of a 30 weight percent colloidal silica dispersion in water. The colloidal silica dispersion is 30 weight percent solids and is available under the tradename of "Ludox HS." To this mixture is added 2.5 parts by weight of a 10 weight percent aqueous solution of a copolymer prepared from diethanol amine and adipic acid in equimolar proportions by carrying out a condensation reaction to give a product having a viscosity of about 100 centipoises at 25° C. One part by weight of a solution containing 2.5 weight percent potassium dichromate is added. The pH of the aqueous solution is adjusted to 4 with hydrochloric acid. Vinylidene chloride is utilized as the monomer. An oil phase mixture is prepared by utilizing 100 parts by weight of vinylidene chloride and 20 parts by weight neopentane (27.6 volume percent based on the total volume of the monomer-neopentane mixture) and 0.1 part by weight of benzoyl peroxide as a catalyst. The oil phase mixture is added to the water phase with violent agitation supplied by a blade rotating at a speed of about 10,000 rpm. The reactor is immediately sealed and a portion sampled to determine the particle size. The droplets appear to have diameters of from 2 to about 10 microns. After the initial dispersion, the reaction mixtures are maintained at a temperature of about 80° C. for a period of 24 hours. At the end of this period, the temperature is lowered and the reaction mixture is found to have the appearance of a white, milky liquid similar to a chalk-white milk. A portion of the mixture is filtered to remove the particles and the particles or beads are subsequently dried for about 1 hour in the air oven at a temperature of 30° C. A portion of the dried spherical particles are heated in an air oven at a temperature of 150° C. for about 3 minutes. Upon heating, the particles show a marked increase in volume. Microscopic examination of the particles prior to foaming indicates particles having diameters of from about 2 to about 10 microns and having disposed therein a distinct spherical zone which appears to contain liquid and a small vapor space. The particles which are heated are examined microscopically and are found to have diameters of from about 2 to 5 times the diameter of the original particles and to have a relatively thin, transparent wall and a gaseous center, i.e., a monocell.

Preferred polymers for preparation of the microspheres are for example, polyvinylidene chloride, a copolymer of vinylidene chloride and acrylonitrile in weight ratios of about 100:1 to about 70:30, copolymers of acrylonitrile and methyl acrylate in weight ratios of from about 90:10 to 80:20, and copolymers of methacrylonitrile and methyl acrylate in weight ratios of about 93:7 to 82:18. While these materials and proportions are preferred, it is not intended that the invention be limited thereto. The preference is grounded principally in convenience and not in any substantive considerations.

By utilizing the technique of limited coalescence, a wide variety of expandable thermoplastic microspheres can be produced and, if desired, may be specifically designed for incorporation into a specific fabric printing medium. Such materials are now generally familiar and are commercially available. The term "microspheres" is herein employed as generic to all such materials.

In the present invention, the microspheres are incorporated into the fabric printing medium in unexpanded form as a disperse phase. In order to preserve the expandable character of the microspheres, it is important that no component of the medium have any substantial solvent effect upon the thermoplastic of the spheres, or if such is not possible or convenient, as an alternative, the microspheres may be treated to preclude or retard solvation. A number of techniques are available to prevent dissolution of the microspheres. Among the simplest of these is a technique useful when the fabric printing medium contains a component having a definite but not great solvent activity. The microspheres are coated with a material which preferentially wets the surface of the microspheres when compared to the solvent vehicle, but which is not a solvent. Butyl alcohols, particularly n-butyl alcohol, are often useful for such purpose when the thermoplastic of the microspheres is poly(vinylidene chloride). In more extreme circumstances, as when the graphic medium contains a strong solvent for the microspheres or when extended shelf life or storage stability is required, more extensive treatments are required. In such contexts, it is useful to coat the microspheres with an adherent polymer coating insoluble in the solvent system of the graphic medium. Among the polymers which can be effectively employed for such purpose, for example, are acrylics, polyesters, alkyds, polyamides, epoxies, urea formaldehydes, phenol formaldehydes, polysiloxanes and the like. By the utilization of such expedients, there is substantially no restrictions upon the solvent systems with which the microspheres can be employed and, consequently, there are correspondingly no related restrictions upon the fabric printing media with which the present invention may be practiced. Of course, many of the common solvent systems do not require any modification of the microspheres, and among these there may be mentioned as examples, water, alkanes (particularly straight chain alkanes), aliphatic alcohols (particularly straight chain aliphatic alcohols), and aromatics, such as benzene and lower alkyl aromatics such as toluene, xylenes and the like. Such solvents can be used singly or in combinations in known fashion.

The microspheres may be incorporated into the fabric printing media at any convenient stage, that is, during the formulation of such media or at a later time up to just prior to use. A wide variety of processing techniques can be employed to effect dispersion of the microspheres, which are readily wetted out in most media and, because of the extremely small dimensions of the particles, are readily mixed and dispersed. In most contexts, a thorough, uniform dispersion is desired, which is attained without difficulty by a simple mixing procedure. Unusual special effects may be attained by incomplete dispersion of the microspheres, and when such effects are desired, less than thorough mixing may be employed.

Depending upon the particular technique of application to be employed with the fabric printing medium, it may be desirable to use an inert or solvent diluent to adjust the viscosity of the medium to compensate for the addition of the microspheres. When the microsphere-modified medium requires such adjustment, it may be cut or thinned in accord with conventional practice applicable to the particular graphic medium employed. When formulated in accordance with the foregoing, the graphic media will have a shelf life and a storage stability usual for the particular medium employed.

Fabric printing media formulated in accordance with the present invention may be applied to a substrate by any of the known and conventional techniques appropriate thereto. Such techniques commonly include, for example, not only the various printing techniques, but also brushing, trowelling, spraying, pouring, dip-coating, silk-screening, stencilling, electrostatic techniques and the like. All these techniques share in common the selective application of a fabric printing medium to a fabric substrate, and all such techniques are contemplated herein. Also contemplated are analogous techniques which involve a uniform application to a fabric substrate, followed by the selective removal of portions of the medium. Such procedures are characteristic of photographic techniques, for example. Because of the finely divided nature of the microspheres, there is no impediment to any of the foregoing techniques attributable to the disperse phase.

The three-dimensional effect which characterizes the media of the present invention is attained by heating the medium to a temperature at which the microspheres expand, usually on the order to about 90°–150° C., more often about 100°–120° C. The degree to which the applied medium expands to attain the raised effect is dependent primarily upon the concentration of the microspheres therein. The degree of expansion is also dependent upon the amount of strike into the fabric and whether the expansion is carried out on a previously dried sample or one that is still wet. While some expansion is attained with concentrations of less than one weight percent based on the total non-volatile content of the medium, the more usually desired effects will require greater concentrations, up to as much as about 45 weight percent microspheres. If greater amounts of microspheres are employed, adherence of the medium to the substrate may be impaired. Then the film forming ability of some types of vehicle may be insufficient. Most often, the desired raised effect will be attained at a concentration of from about 5 to 40 percent, and preferably about 10 to 30 weight percent, although it should be noted that such concentrations are not ordinarily narrowly significant or critical.

The heating which causes the microspheres to expand to produce the three-dimensional effect also causes the binder polymer to cross-link. In order to attain good permanence when the fabric is to be washable as well as dry-cleanable, a post cure is required. This operation requires a temperature of about 300° F. for a period of about one minute. It is essential to note that post cures of shorter duration or lower temperature are ordinarily not fully effective while higher temperatures and longer periods may cause damage or degradation to the applied medium and/or to the fabric substrate. It is noted that as employed herein the term dry-cleanable is used to connote resistance to conventional dry-cleaning solvents, such as perchoroethane. The fabrics bearing patterns and designs in accordance with the present invention are also machine washable, with the limitations generally applicable to such operations.

Since the indices of refraction of the binder and the microspheres will not ordinarily be the same, unless particular pains are taken to so formulate the medium, the raised media will not ordinarily be transparent but rather will usually be opaque or translucent. Since transparency is ordinarily undesirable in such media, such effect may in fact be quite beneficial, as the expanded microspheres will also serve to enhance the covering or tinting capacity of the medium and may even, in some cases, replace or reinforce the effect of additives employed for such purpose, e.g., opacifiers, such as titanium dioxide, zinc oxide, talc or the like. In the absence of colorant, the medium will have a white appearance or a color attributable to the binder, or the fabric substrate. On the other hand, the expansion of the microspheres will increase the relative dispersion of pigments contained in the binder and result in pale shades or pastels, even in the case of high pigment loadings. In such circumstances, an overprint of the same or a different formulation without microspheres may be desirable to attain bold tints. Such overprints pose no difficulties for those of ordinary skill in the art.

The substrate to which the printing media may be applied in accordance with the present invention can be any with which the particular medium is compatible and to which such medium is adherent. Such substrates commonly will include various types and textures of fabrics, such as those commonly employed as, draperies, clothing, wall coverings, upholstery particularly fabrics of such materials as cotton, rayon, rayon-acetate, Dacron and compositions thereof, fiberglass, polyesters, polyacrylates, polyacrylonitrile, polyhydrocarbons, various blends thereof, and the like, and including both woven and non-woven fabrics and the like.

When the fabric printing media of the present invention are applied to a fabric substrate and developed by heating to the temperature at which the microspheres expand, the applied medium will have a raised and textured surface. The medium becomes a thin film of a syntactic foam which projects outwardly from the surface of the fabric substrate. The thickness of the developed medium will be dependent upon the thickness of application of the medium and upon the concentration of the microspheres therein. The surface will be textured or roughened by the irregularities caused by expansion of the microspheres present just adjacent to the surface of the medium, and the degree of texture will be largely dependent upon the concentration of the microspheres. In circumstances where the rough texture is not desirable, it can be eliminated by any overprint of a conventional medium without loss of the raised or three-dimensional effect. Preferably such over-print will be the same medium without the microsphere loading, and may, as already discussed, be additionally desirable in increasing the intensity and tint of colors.

It is noteworthy that the properties of the developed media of the present invention will be determined by the basic medium formulation employed and will be little altered by the presence of the microspheres except in their function as "foaming agents". Thus, it is apparent that the properties of the developed medium can be tailored to the intended use on the basis of the chemical and physical properties of the components included in the base formulation with emphasis upon the microspheres and their physical and chemical characteristics. In the compositions generally contemplated in the present invention, the developed medium will comprise a continuous phase matrix of the base medium and a disperse phase of the expanded microspheres. Because the expanded microspheres are not contiguous, the medium has a great degree of integrity determined by the cohesiveness of the continuous phase, which in most such media, will be considerable.

While many variations of the present invention are contemplated, the considerable simplicity of the invention and its fundamental concepts enable those of ordinary skill in the fabric arts to implement the practice of the invention with a minimum of specific guidance once the basic nature of the invention is clearly understood. However, it may be informative to refer to the following specific examples which illustrate a few of the numerous facets of fabric decorative technology which can advantageously employ the present invention. These examples are intended to be illustrative only and should not be construed as limiting the scope of the invention, which is defined only by the claims appended hereto.

EXAMPLE I

A cross-linkable acrylic emulsion coating in accordance with the present invention was prepared by combining, in the specified proportions, the following ingredients:

| | | |
|---|---|---|
| Acrylic emulsion | 63.95 | parts by weight |
| Defoamer | 0.25 | |
| Wetting agent | 0.10 | |
| Glycol ether | 2.74 | |
| Microspheres | 31.47 | |
| Catalyst | 0.1 | |
| Thickening agent | 1.39 | |

All the foregoing components with the exception of the thickening agent are combined and mixed until homogeneous. Then the thickening agent is added and the mixing is continued until the thickening agent is dispersed.

In the present Example the acrylic emulsion is the product commercially available as "TR-520", a product of Rohm and Haas Company and is a 50% solids aqueous emulsion of a copolymer of 94 weight percent ethyl acrylate and 6 weight percent acrylic acid. The emulsion contains ethylene diamine as a cross-linking agent. The defoamer is the proprietary product "Nilfoam 7" commercially available from Naftone Company. Still other products may be substituted including for example Nopco Chemical Company's "DF-160L", Crucible Chemicals Company's "Foamkill 649" and other similar products generally familiar to those of ordinary skill in the art.

The wetting agent employed in the present example was "Triton X-100", available from Rohm and Haas.

The glycol ether is diethylene glycol ether. It is equally possible to utilize ethylene, propylene, and dipropylene glycol ethers, dibutylene glycol ether and the like, and mixtures thereof.

The microspheres as employed in the present example were utilized as applied by the Dow Chemical Company. The microspheres were supplied in the form of 75% microspheres and 25% water and the microspheres themselves were of polyvinylidene chloride having a particle size range, unexpanded, of generally about 2 to 8 microns and containing about 20 weight percent nepentane, based on the weight of the polymer. The catalyst, which facilitates cross-linking of the acrylic emulsion is of the latent acid type and in the present Example was citric acid. Other acids such as oxalic acid, adipic acid and malonic acid and the like also be employed.

The thickening agent in the present Example was fumed silica.

The formulation prepared as above will have a viscosity of about 60,000 centipoise, which may thereafter be adjusted to an appropriate value for the particular application technique intended. For example, when it is intended to employ the composition for silkscreening techniques, a viscosity in the range of about 12,000 to 60,000 cps. is desired. With viscosities lower than this particular range excessive flowing on the substrate and a loss of detail will occur. If the viscosity is greater than about 60,000 cps. the composition will not properly pass through the screen openings and consequently coverage and the amount of expansion will be reduced. On the other hand when application by roller printing or gravure printing is intended, the preferred viscosity ranges about 300 to 15,000 cps. Viscosities below this range could produce excessive flowing and loss of detail on the substrate, while viscosities above this range will result in insufficient coverage and poor expansion characteristics. Adjustment of viscosity is conveniently attained by thinning with water and is most conveniently employed as and adjunct to the inclusion of a pigment into the coating formulation. Thus an aqueous pigment dispersion and additional water for the control of viscosity may be added together, with mixing to assure good distribution and an even emulsion.

EXAMPLE II

The formulation set forth in Example I, pigmented via a pigment dispersion and adjusted to a viscosity of 25,000 cps., is applied to acetate rayon, cotton, fiberglass, fabrics via flatbed, hand operated silkscreen equipment. The screen sizes employed were 6XX, 12XX, or 16XX. The coated materials are then dried and expanded both sequentially and as a single operation. Drying is accomplished between room temperature and 190° F. Expansion or dry/expansion is carried out between 200° and 320° F. for 15 seconds to 2 minutes. A post cure of 300° F for one to three minutes is employed for curing of the system. The coating applied varied from 20 to 500 microns in thickness. The foamed coated fabrics were examined and found to be 50 to 1000 microns, resistant to conventional dry-cleaning fluids, such as perchlorethylene. It is also machine washable.

EXAMPLE III

All the conditions and results described in Example II were repeated, except that the method of application is Rotary Screen (Riggioni). The mesh sizes of screen were 40 to 60. Fabric traveled through the press at between 20 and 100 yards per minute. Dry/expansion was conducted in a programmed oven for 30 seconds to 3 minutes at temperatures between 250° F. and 300° F. followed by curing at 300° F. for an additional 1.5 minutes.

EXAMPLE IV

All the conditions and results described in Example II were again repeated, except that the method of application is roller printer and viscosity of the formulation described in Example I, was adjusted to 12,000 cps. Speed of fabric moving through press was varied from 10 to 100 yards/minute. Depth of etch on the cylinder is 0.008 in giving an application of 30 to 50 lbs./1000 yds.$^2$ Time/temperature cycle on dry/expansion is 15 seconds to 2 minutes at 200°–300° F., with cure 2 minutes at 300° F.

EXAMPLE V

All the conditions and results described in Example III were again repeated, except that the method of application is gravure printing. Viscosity of formulation described in Example I is varied between 300 and 15,000 cps. A pattern is applied to the face at approximately 35–40 lbs./1000 yds.$^2$, using a 55-line quadrangular cylinder, 65 microns deep. Total coverage is applied to the backside at approximately 100–115 lbs./1000 yds.$^2$, using either a 45-line quadrangular cylinder, 68 microns deep; or a 26-line tri-helical cylinder 130 microns deep. Drying, expansion, and cure were the same as in Example IV.

What is claimed is:

1. The method of forming a washable and dry-cleanable foamed print on a washable and dry-cleanable fabric substrate comprising selectively applying to said substrate a printing composition comprising an adherent film forming cross-linkable polymer binder in a liquid vehicle therefore, said composition containing about 1.0 to 45 weight percent, based on the weight of said binder, of thermoplastic, thermally expandable microspheres about 0.5 to about 300 microns in diameter; drying to remove said liquid vehicle to form a dispersion of said microspheres in said binder; heating to expand said microspheres and cross-link said polymer binder to form a raised and textured surface; and curing the cross-linked polymer binder at a temperature of about 300° F for a period of about 1 to 3 minutes.

2. The method of claim 1 wherein said cross-linkable polymer binder is a copolymer of 90 to 99 weight percent ethyl acrylate and 10 to 1 weight percent of an addition copolymerizable carboxylic acid group containing monomer selected from the group consisting of maleic, fumaric, and acrylic acids.

3. The method of claim 2 wherein said cross-linkable polymer binder is cross-linked by a difunctional amine cross-linking agent.

4. A dry-cleanable foamed printing on a fabric substrate comprising the product of the process of claim 1.

5. The method of claim 1 wherein the drying and heating steps are conducted sequentially, and wherein the drying step temperature is from about room temperature to about 190° F and the heating step temperature is from about 200° to about 320° F.

6. The method of claim 1 wherein the drying and heating steps are conducted simultaneously at a temperature of from about 200° to about 320° F.

7. The method of claim 1 comprising the further step, after curing, of overprinting at least the raised and textured surface with a binder composition which does not contain microspheres.

8. The method of claim 7 wherein both the binder containing microspheres and the overprinting binder contain pigments.

9. The method of claim 1 wherein the microspheres have a diameter of from about 3 to about 50 microns.

10. The method of claim 9 wherein the microspheres have a diameter of from about 5 to about 20 microns.

* * * * *